US005573050A

United States Patent [19]

Henkenjohann

[11] Patent Number: 5,573,050

[45] Date of Patent: Nov. 12, 1996

[54] LOCKING DEVICE FOR A SLATTED ROLL-UP GATE OR DOOR

[76] Inventor: Johann Henkenjohann, Oesterwieher Strasse 80, D-33415 Verl, Germany

[21] Appl. No.: 358,564

[22] Filed: Dec. 14, 1994

[30] Foreign Application Priority Data

Dec. 17, 1993 [DE] Germany ..... 43 43 310.3

[51] Int. Cl.[6] ..... E06B 9/08

[52] U.S. Cl. ..... 160/133; 160/290.1; 292/230; 292/DIG. 20

[58] Field of Search ..... 160/133, 201, 160/327, 328, 354, 236, 84.06, 273.1, 274, 290.1, 378, 270, 188; 292/DIG. 36, 230, 198, DIG. 20, 22

[56] References Cited

FOREIGN PATENT DOCUMENTS

| | | | |
|---|---|---|---|
| 2636092 | 3/1990 | France | 160/133 |
| 341009 | 9/1921 | Germany | 160/133 |
| 2615918 | 10/1977 | Germany | 160/133 |
| 2745560 | 4/1979 | Germany | 160/133 |
| 567950 | 10/1957 | Italy | 160/133 |

*Primary Examiner*—Blair Johnson
*Attorney, Agent, or Firm*—Burns, Doane, Swecker & Mathis, L.L.P.

[57] ABSTRACT

A roll-up closure for closing/opening a vertical opening such as a window or door, includes vertically spaced, horizontal slats, the ends of the slats being slidable in vertical guide channels. The lowermost slat carries a catch which is biased outwardly to a position preventing the closure from being raised. The catch can be released to permit raising of the closure, by means of a cable, a manually actuable member, or a mechanically actuable member.

27 Claims, 5 Drawing Sheets

LOCKING DEVICE FOR A SLATTED ROLL-UP GATE OR DOOR

FIELD OF THE INVENTION

The invention relates to a locking device for a roll-up closure such as a blind, gate, or door which can be rolled up and down upon a shaft and that includes slats that slide inside vertical guides, the first of such slats being attached to the shaft and the last (lowermost) slat positioned on the outer window sill.

BACKGROUND OF THE INVENTION

The security of home entrances is becoming increasingly important with break-in attempts on the rise. A number of different suggestions have already been made with a view to increasing the security of home entrances having roll-up blinds or doors.

DE-PS 30 19 566 and DE-OS 25 21 183 propose that the lowest slat be fitted with laterally-slidable locking bolts that interact with a spring the force of which presses such bolts into a specially provided bolt recess whenever, during closing of the roll-up blind or door, the force that pulls against the spring tension is absent. The force is transmitted by a cable that connects the uppermost securing bolt to the bolt provided in the lowest slat. This arrangement makes use of the fact that, during opening and closing, the space separating the slats of a roll-up blind, gate or door will be greater than that separating the slats when the roll-up blind, gate or door is closed. This difference is transmitted to the locking bolt via a traction cable that runs from one of the upper slats to the last, lowermost slat.

During opening and closing, the locking bolt is retracted by means of the traction cable. When the blind is in the closed position, where due to the narrower gap between the slats, the traction cable is relaxed, the securing bolt is slid outwards under spring tension into the lateral recesses. If at this point an upper slat is lifted up during a break-in attempt, the slats are further separated from each other, which causes the traction cable to tighten, which in turn causes the securing bolt to retract, the result being that the roll-up blind, gate or door can now be opened by pushing up from the bottom.

The disadvantage of this arrangement is that the locking action depends on the reduction in cable tension; however, the cable tension remains the same, if for instance, the cable jams, which would prevent locking. Alternatively, should the spring break, the locking bolt could be forced into the locking position, a condition that will not always be noticed, particularly if the roll-up blind, gate or door is controlled automatically by means of timer or light switches. Furthermore, and particularly wherever varying widths of roll-up blinds or doors are available, a single or double-sided securing system is no longer considered to be adequate. Rather, there is a need for securing devices that lock at several points.

SUMMARY OF A PREFERRED EMBODIMENT OF THE INVENTION

One object of the invention, therefore, is to provide a locking device of the aforementioned type in which such disadvantages are obviated, and in which the locking device is slidable into the locking position without any additional power means, and which, spanning the entire width of roll-up blind, gate or door, does not include locking arrangements at the ends of the door, and is moreover simple and economical to manufacture and install.

A further object of one embodiment of the present invention is to provide in a locking device for a roll-up blind, gate or door having slats rollable up and down on a shaft, the slats being slidable inside lateral guides, a first of the slats being attached to the shaft and a last slat adapted to rest upon an outer window sill, the improvement wherein at least one of the slats includes along its length a recess for receiving a pivotally movable catch, the catch including a foot, the foot positioned inside a groove of an open cavity that opens toward the window, of a recess that is provided in the slat profile, the catch, adapted for insertion into the cavity of the recess, including a foot, the foot being offset relative to a center of gravity of the catch, the foot having a profile capable of sliding inside the groove, whereby the catch can flip out freely when the end slat comes to rest upon the outer window sill; and blocking means associated with one of the lateral guides for interacting with the catch when the roll-up blind, gate or door is moved upwards.

In order to lock the door in the required manner, one of the slats of the roll-up blind, gate or door is provided along its entire length with a flip catch. The foot of the catch which is received in a groove situated in a recess which, opening toward the window, is situated itself inside a profile slat, whereby the flip catch, which can be inserted into this recess, features a foot which, in addition to having a profile capable of sliding inside the groove, is offset in the direction of the profile slat relative to the center of gravity of the catch. In this arrangement, the catch is permitted to flip outwardly whenever the end slat comes to rest upon the outer window sill, and at least one, and advantageously both of the lateral guide profiles feature a projection that blocks the flip catch as it projects from the profile slat. This design permits the free movement of the flip catch, the moment of rotation of which, due to weight distribution, forces the flip catch to tip out of the profile slat, to protrude beyond the limits of the profile without any additional springs or other motive means, given that the lateral guide profile end at least on its reverse side at the notch facing the window, which releases the flip catch. The flip catch, which extends beyond the profile of the slat, is now capable, during any attempt to raise up the roll-up blind, gate or door, of hooking beneath the blocking projection, which, in its simplest form, consists of the notched profile of the lateral guide. Every attempt at raising the door now results in its being locked ever more tightly.

This is accomplished largely because the end slat is provided with the flip catch. In order for the flip catch to be held in position when it is pushed into the recess inside the profile or end slat, securing elements are installed on at least one, and preferably both sides and fit snugly and into and are secured inside the slat profile.

The flip catch is prevented from flipping upward by means of the blocking projection, beneath which the flip catch, which projects beyond the profile of the slat, hooks. The restraining catch is formed by a notch located on one side of the lateral guide profile, the immobile portion of which forming the catch. It is advantageous if, inserted into the cut-out formed by the notch in the lateral guide profile, is an insert which, for the sake of rigidity, comprises steel. In order to prevent corrosion, the steel used in this case is special stainless steel.

This insert prevents the flip catch from being accessed from the outside; moreover, this insert absorbs the force that is applied in an attempt to raise up the roll-up blind, gate or door. Since the insert can also be anchored in the masonry independently of the lateral guide profile, this force can also be channelled directly into the masonry surrounding the window, gate or door. In order to prevent the partially released flip catch from impeding the upward movement of the roll-up blind, gate or door, provided in the entrance to the lateral guide profile is an entry slope that is bent only slightly outwards and that presses the flip catch into the profile of the slat, if the flip catch has not been fully moved into the unlocked position.

This slope also securely restrains the flipped-out flip catch, in which situation its front serves as the blocking projection, and it can be fitted with a separate insert, which can be fitted in the notch located in the lateral guide profile.

For locking purposes, catches of the aforementioned shape can be provided on both lateral guides. Since the flip catch is embodied as a profile extending the entire length of the slat, additional catches can also be provided between both lateral guide profiles, for example, on the vertical sections of the window frame. This arrangement also permits secure locking of unusually wide roll-up blinds, gates and doors, which prevents them from being pushed up.

In order to unlock the flipped-out flip catch whenever the roll-up blind, gate or door is to be raised to a predetermined height, the flip catch is embodied as a profile that runs the entire length of the last slat. In this arrangement, the catch is locked by means of only one device, which can be sited at any point in order to engage the flip catch for the purpose of returning the entire length of the flip catch to the normal, disengaged position. This arrangement enables the fitting of catches without the need to install an unlocking device at the location of each catch. It is advantageous if catches are provided at least on both sides of the roll-up blind, gate, or door.

In this type of design, it is advantageous if additional catches be provided between both lateral guide profiles. In this way, the forces generated by unauthorized opening can be effectively distributed even if the roll-up blind, gate, or door is unusually wide.

A device for disengaging the flip catch can consist of a pin, which, being arranged at the height of the outer window sill, acts to disengage the flip catch. This pin acts to return the flip catch to its normal position, so that when the roll-up blind, gate or door is opened, the flip catch will run into the lateral guides. If the roll-up blind, gate or door is opened manually, it is advantageous if the disengaging pin be operated manually and feature a delayed return action; in such a case, the roll-up blind, gate or door can, following disengagement, be raised upwards and run into the lateral guide profile before having a chance to tip backwards. This delay can, for example, be achieved by introducing a resilient-elastically bendable disengaging rod, controllable from the inside, through the outer window frame. Provided on the outer extremity of the disengaging rod is a slide shoe that interacts with the flip catch, and which, when the latter is pushed into the recess in the profile slat, depresses and holds the catch in position. In order to maintain the catch in this position, the disengaging rod is fitted with a blocking ring, and provided on the outer side of the outer window frame is a restraining finger over which the blocking ring is lifted whenever pressure is exerted on the pin, by means of which arrangement the disengaging rod is prevented from retracting. When the roll-up blind, gate or door is lifted up, the slide shoe is carried along with the door due to friction, the resilient-elastically-bendable disengaging rod bends and, when such bending surpasses a certain point, the blocking ring is lifted over the restraining finger and the disengaging rod pulled back or withdrawn by means of a return spring. The mechanism that restrains the disengaging rod is designed to permit the flip catch to have already entered the lateral guide profile by the time the blocking ring is lifted over the restraining finger. This arrangement ensures the secure and trouble-free disengagement of the flip catch. If the disengaging mechanism is coupled to a drive motor, for example with a solenoid, it suffices if the activation of the solenoid, lasts at least until the flip catch has run securely into the lateral guide profile.

In one advantageous embodiment of the invention, the pin interacts with an adjustment member that is controlled by means of a switch. In such an arrangement, where the roll-up blind, gate or door is actuated by means of a motor, the member adjusting the pin is advantageously actuated when the switch is flipped to cause the door to lift up. This actuation capability ensures that the flip catch will lock when the door is lowered. Once reaching the final position, the flip catch will fall by itself into the locked position. Should the roll-up blind, gate, or door be set into upward movement, without the locking pin being disengaged, the roll-up blind, gate, or door can be set to "gap", for the purpose of admitting light or air. In such a case, the motor should be fitted with a cut-out switch that stops the opening action if the flipped-down flip catch hooks underneath the locking projection.

It will, of course, be appreciated that the locking surface of the flip catch is substantially smooth, so that it can be forced out of the locked position into the unlocked position. In this arrangement, the adjusting member can be either a solenoid or a servomotor. These are wired so that they can be actuated if the roll-up blind, gate or door is opened, in which case the actuation lasts at least until the flip catch has moved into the region of the lateral guide profiles and is restrained by the latter in the recess of the profile slat.

In an alternative embodiment of the invention, a sheathed cable is provided for the purpose of disengaging the flip catch. In this arrangement, the sheathed cable is connected either to the first slat or to the shaft and is, during roll-up is pulled along with the blind and accordingly tightened, which causes the flipped-down catch to be pulled into the disengaged position. The height by which the cable can be raised should, in this arrangement, correspond to the length of cable required to pull the flip catch from the flipped-down position into the disengaged position. In order to accomplish trouble-free disengagement of the flip catch when the roll-up blind, gate or door is lifted up, the length of the sheathed cable is adjusted so as to enable the flip catch to move into the disengaged position only after the slats have been fully pulled apart, and thus set to the "gap" position. Where roll-up blinds, gates or doors of greater length are used, this traction cable length is arrived at by using (relatively) fewer slats. In order to effectively unlock longer roll-up blinds, gates or doors, the cable connects to an auxiliary slat located at a suitable distance from the last slat.

In order to guide the traction cable, at least some of the end stops, which are located at the extremities of the slats, are provided with guide eyes, though which the traction cable is able to run. Such guide eyes ensure proper guidance of the cable and prevent it from snagging when it falls slack when the roll-up blind, gate or door opens. The traction cable affords a simple means of adjusting the roll-up blind, gate or door to "gap" in order to admit light or air, since the traction cable must firstly be tightened by lifting the slats; this tightening can be adjusted in order to permit the slats to move immediately into the "gap" position.

BRIEF DESCRIPTION OF THE DRAWINGS

The objects and advantages of the invention will become apparent from the following detailed description of the preferred embodiments thereof in connection with the accompanying drawings, in which like numerals designate like elements, and in which.

DETAILED DESCRIPTION OF PREFERRED EMBODIMENTS OF THE INVENTION

Figure 1:
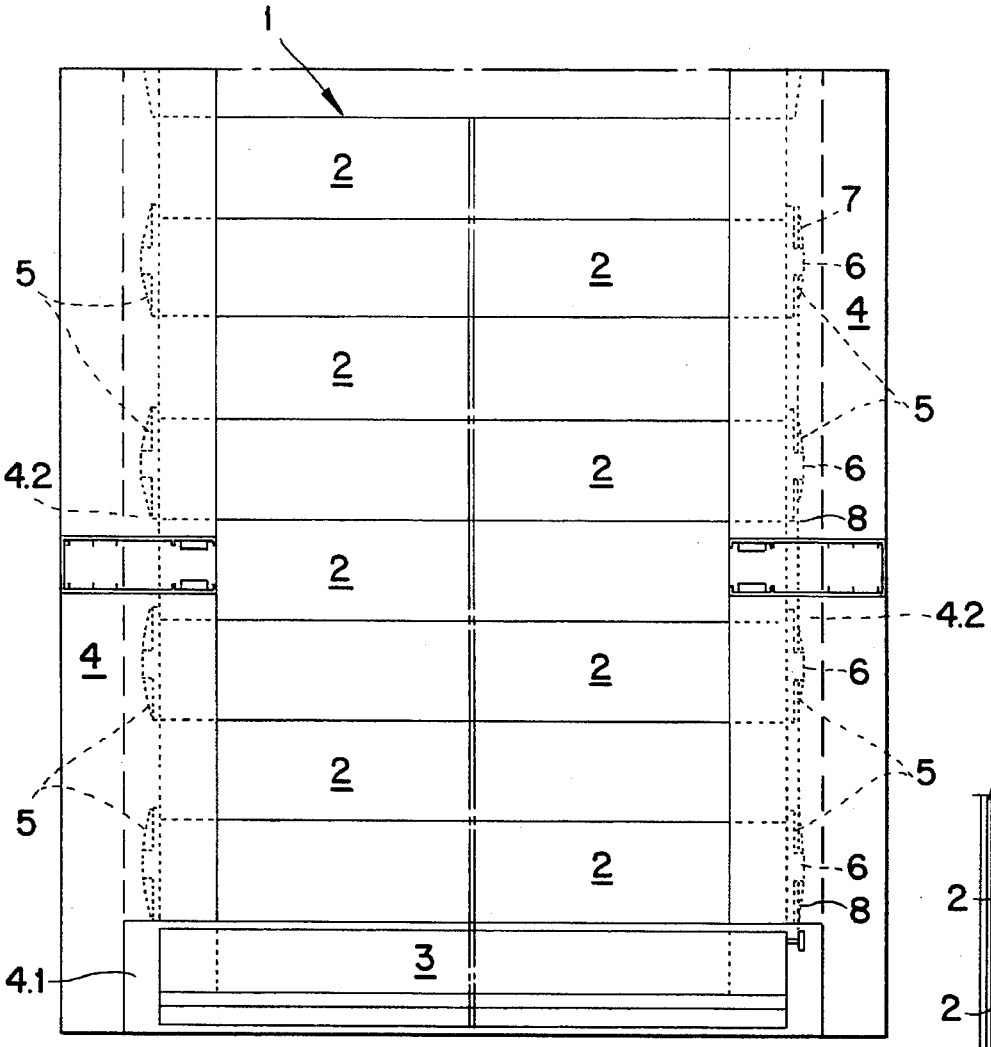
FIG. 1 is a front view of a roll-up blind in a closed (down) state.
Figure 2:
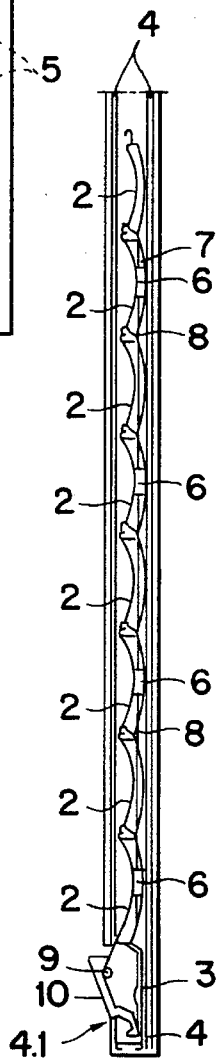
FIG. 2 is a side view of the blind as it is guided in a vertical slat.

FIGS. 1 and 2 illustrate from the rear and side, respectively, a closed roll-up blind 1 having a number of slats 2. The latter are suspended relative to each other in the conventional manner, i.e., one in which the blind is opened by means of a strap (not shown) and when being rolled up, is rolled up upon a shaft (not shown). In this arrangement, it is irrelevant whether or not the rolling action is manual or automatic.

The blind is closed in the reverse manner: the slats 2 are rolled off the shaft and lowered with the aid of straps, whereby the end slat 3, which constitutes the lowermost slat, can be lowered until it comes to rest upon the outside window sill, and whereby the other slats 2 are suspended with gaps between each of them. These gaps close, if, when being lowered, enough slack has been allowed in order to permit the strap to loosen.

Laterally, the slats 2 as well as end slat 3 are guided in guides having vertical guide channels 4.3 (see FIG. 7*a*), in which the end stops 5 of the slats slide. In the Figures, the end slat 3, which occupies the lowest position, is fitted over its entire length with a flip catch 10 mounted in a cavity 3.2 of the slat 3, and thus the cavity 3.2 extends the complete length of the end slat 3. Flip catch 10 runs inside both guide channels 4.3 of the lateral guides 4, whereby their walls feature, in the region of the lower ends, recesses 4.1 that open rearwardly, i.e., toward the window, the height of such recesses corresponding to the height at which flip catch 10 sits. The recesses 4.1 lie in a common plane P oriented parallel to a plane P' in which the cavity 3.2 is disposed (see FIG. 4). Having reached recess 4.1 after roll-up blind 1 descends, flip catch 10 is able to flip from its guided position in the channels 4.3 (see FIG. 3) and into the flipped-down position (see FIG. 4). Should an attempt be made to lift roll-up blind 1, the flipped-down catch hooks underneath the wall 4.2 of the lateral guide 4, blocking the upward movement of the blind.

Provided for the purpose of releasing flip catch 10 is a sheathed cable 8 which runs over a number of the slats 2, the end stops 5 of which slats feature guide holes 6, through which the traction cable 8 freely runs. The length of sheathed cable 8 (and thus the number of slats 2 which are bridged by sheathed cable 8) is at the very least sufficient to allow the creation of the spaces, which are formed between the slats 2 and between the end slat 3 and the adjacent slat 2 during raising of roll-up blind 1, and to use enough cable to pull and hold catch 10 in its disengaged position. The length of the cable can be adjusted if a clamp sleeve 7 is fitted to the cable, which strikes against a stop 9 on flip catch 10, above the guide hole 6 provided in the stop. It is advantageous if this attachment can be made on the uppermost of slats 2 or on the shaft, an arrangement that can prevent disengagement of the flip catch by lifting up of one of the upper slats.

Figure 3:
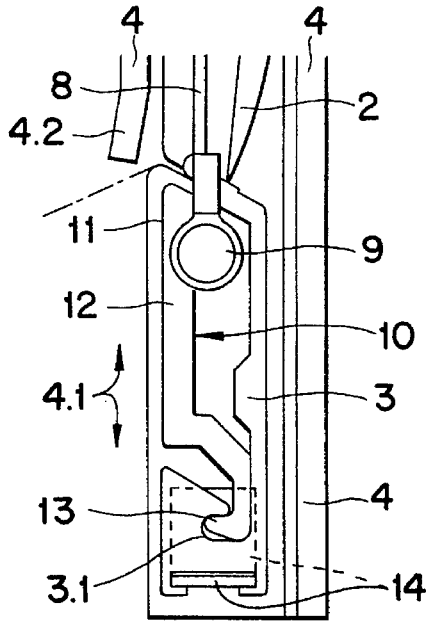
FIG. 3 is a detailed view of the last (bottommost) slat with a flip catch in the disengaged position.
Figure 4:
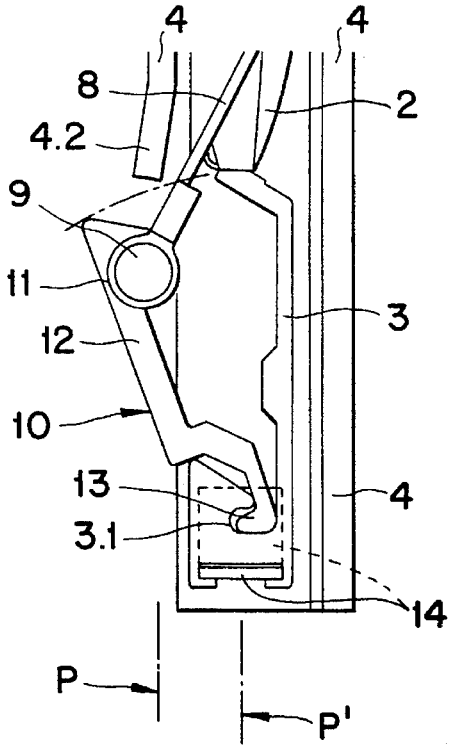
FIG. 4 is a similar view as FIG. 3, in which the flip catch is in the engaged position.

FIGS. 3 and 4 illustrate the flip catch 10 in greater detail; flip catch 10 comprises a profile, which, extending the entire width of roll-up blind 1, features a head part 11, a middle member 12 and a foot 13. The arrangement of head part 11 and middle member 12 relative to the foot is such that the resulting weight distribution establishes a tilting moment or bias in a rearward direction toward the recess 4.1 located in lateral guide 4. This is due to the fact that the foot 13 is offset inwardly (forwardly) relative to middle member 12 and head part 11.

The profile of end slat 3 features a cavity into which flip catch 10 can be completely inserted. In order to permit the flip catch to flip freely, the profile is fitted near the bottom with a groove 3.1 in which the catch is pivotably mounted about an axis A extending parallel to the length of the slat 3 (see FIG. 7*a*). This groove, by accommodating the foot 13 of the flip catch with a suitable degree of play, permits the catch to flip freely, without need of a separate hinge or similar element. Flip catch 10, which extends the entire length of end slat 3, is itself prevented from moving laterally inside the lateral guides 4 by angle brackets 14 installed on one or both guides. The brackets (or inserts) 14 also prevent the flip catch from being accessed by an intruder. In order to compensate for any inaccurate positioning of the flip catch 10, when in the cavity of end slat 3, caused by variations (increases) in the length of cable 8, the lower edge of the wall 4.2 is inclined rearwardly (to the left in FIG. 3) to cam the flip catch back into the cavity during raising of the end slat 3 if, for example, due to an increase in temperature, the length of sheathed cable 8 has increased slightly. Otherwise, the flip catch 10 would not be completely pulled into the cavity. In such a case, length compensation, which may also be accomplished with the aid of springs, would be required, since the temperature variations to which the sheathed cable is exposed, are considerable, and precise adjustment of the sheathed cable length at high temperatures will cause the cable to become too short at low temperatures and too long at high temperatures.

Figure 5A:
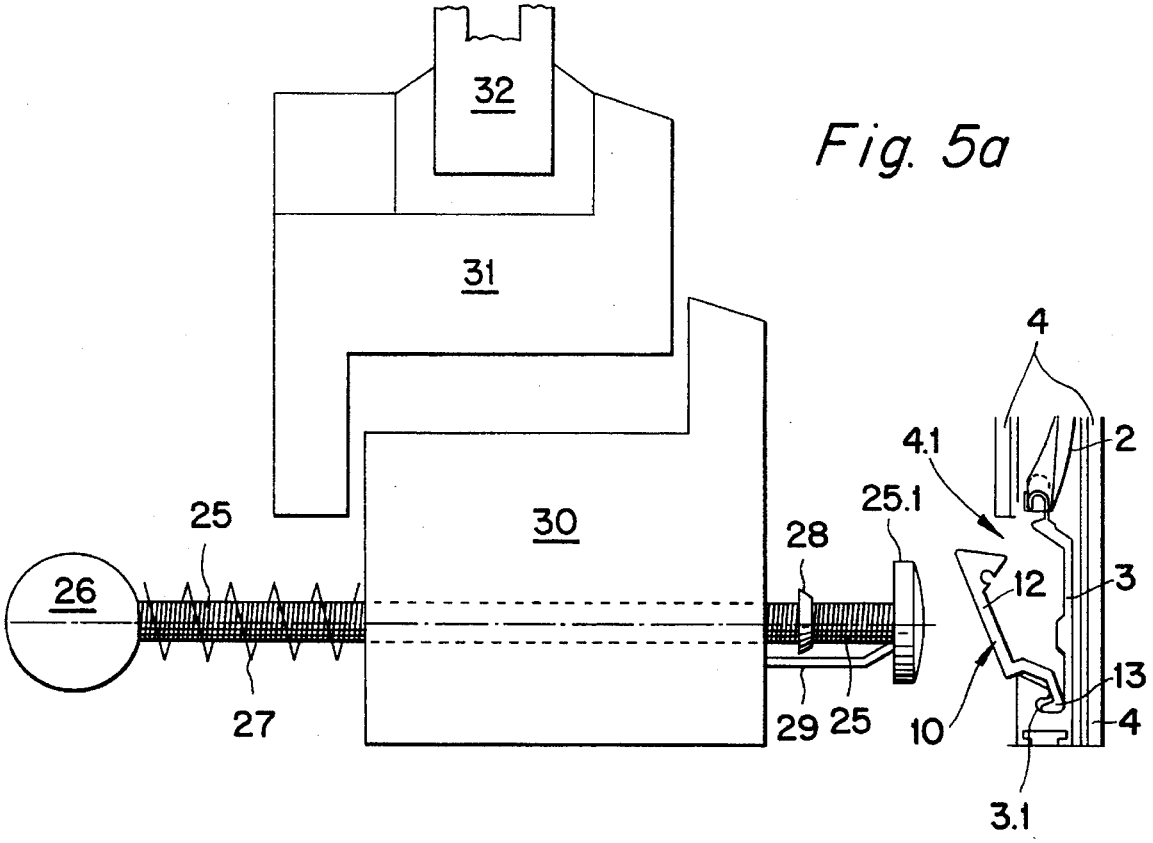
FIG. 5*a* is a side view of a manually actuable flip catch in an engaged position.
Figure 5B:
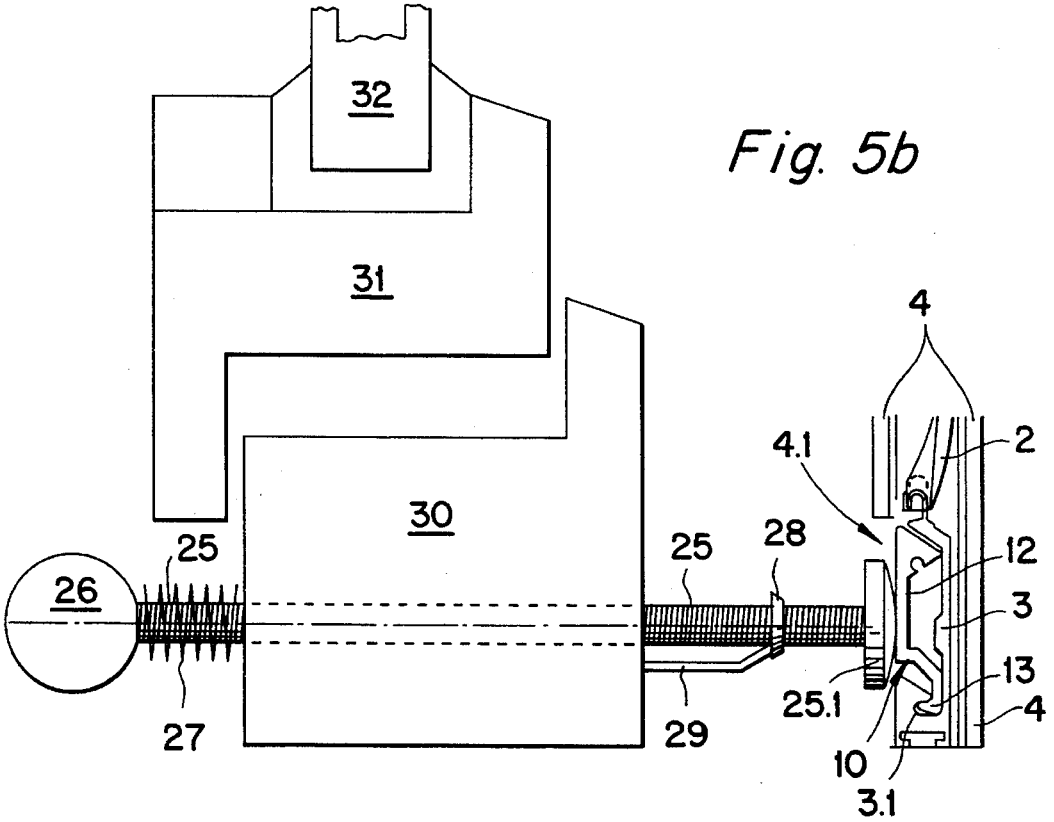
FIG. 5*b* illustrates the manually actuable flip catch of FIG. 5*a* in a disengaged position.

FIGS. 5*a* and 5*b* show an alternative embodiment having a manually-operated disengaging mechanism. The disengaging procedure is accomplished through an immobile side 30 of the surrounding frame of the window that possesses pivotable inner frame 31, which is fitted with glazing 32. This disengaging mechanism comprises an unlocking bolt 25 that may be manually depressed with the aid of control knob 26. Arranged on the free end of unlocking bolt 25 is a slide shoe 25.1 which interacts with flip catch 10. In the event the disengaging mechanism, shown in FIG. 5*a* in a resting position, is depressed, the slide shoe presses against the flipped-out flip catch 10. Further pressure moves flip catch 10 into its retracted position inside the profile of end slat 3. This procedure releases the flip catch. Now that the roll-up blind, gate or door can be lifted up, the flip catch can enter the lateral guide profiles if the flip catch has, up to this point in time, been securely held in position by means of the slide shoe 25.1. In order to ensure that this takes place, a blocking ring 28, which is fitted around unlocking bolt 25, is, when locking bolt 25 is pressed through the frame, carried along with the locking bolt 25 and prevented from moving backwards by means of a stop in the form of a stationary restraining finger 29 so that unlocking bolt 25 will remain in the depressed position until roll-up blind, gate or door has been raised up far enough to permit flip catch 10 to run within the lateral guides 4 and thus be incapable of flipping out again into the engaged position. The unlocking bolt can comprise a resiliently/elastically bendable member such as a Bowden cable pipe. The friction of slide shoe 25.1 against flip catch 10 permits it to be carried with the latter and disengaged when roll-up blind, gate or door is raised up, thereby bending the locking bolt 25 upwardly sufficiently for the ring 28 to become disengaged from the finger 29. Only after the disengaging rod has been disengaged far enough to allow blocking ring 28 to be lifted over restraining finger 29, can the disengaging rod be retracted by means of the force stored in the retraction spring 27, which was placed under tension when the disengaging rod was first depressed; the disengaging rod 25 thus retracts under time delay.

Figure 6A:
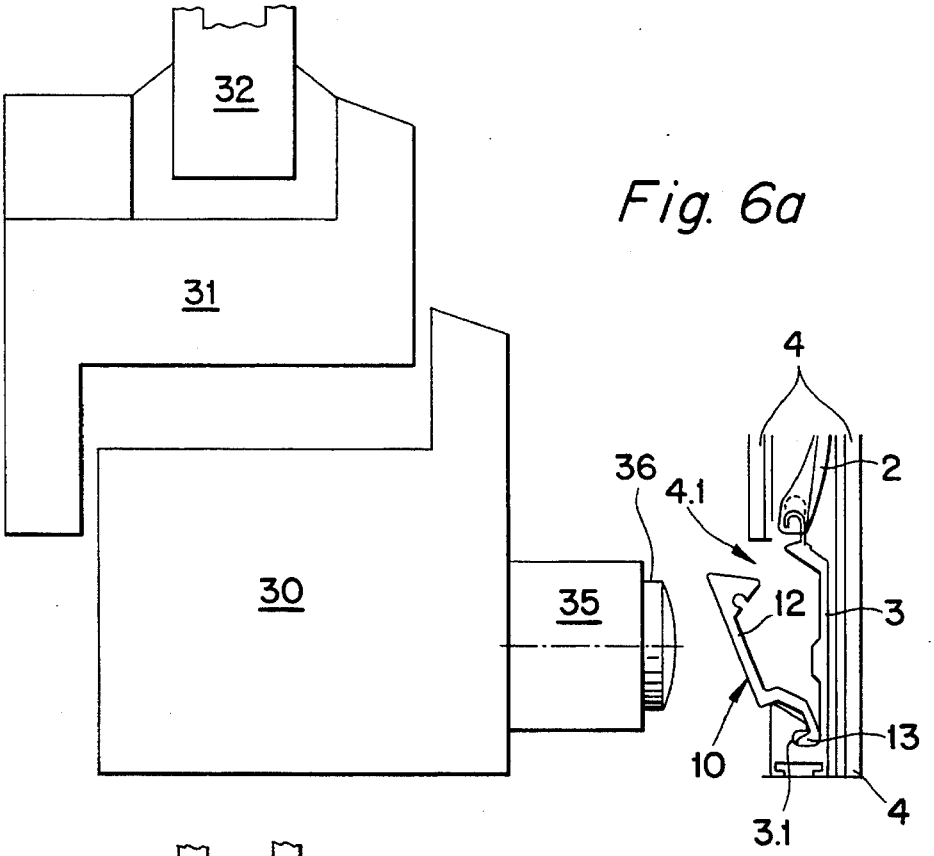
FIG. 6*a* illustrates a mechanically actuable flip catch in the engaged position.
Figure 6B:
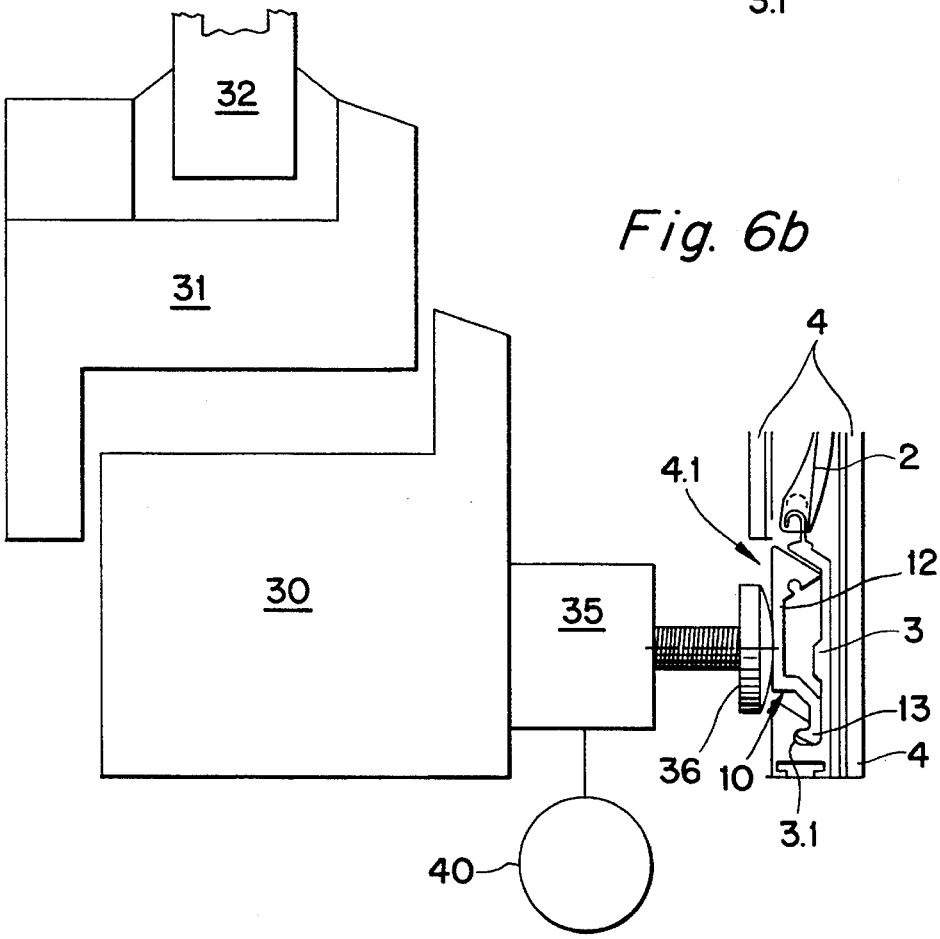
FIG. 6*b* illustrates the flip catch of FIG. 6*a* in the disengaged position.

FIGS. 6*a* and 6*b* show, analogously to FIGS. 5*a* and 5*b*, another unlocking arrangement, which can be controlled from a remote location with the aid of a solenoid 35.

In this embodiment, a solenoid 35 is arranged on the immobile side 30 of the surrounding frame of the window, which supports an inner frame 31 having glazing 32. The solenoid 35 can be controlled via an electrical connection that is not illustrated in greater detail. Should roll-up blind, gate or door be automatically lowered or opened by a motor 40, this control system is advantageously coupled to the motor control so that the magnet can be activated only in the event that the gate is actuated for upward motion. When solenoid 35 is activated, the release bolt presses against and force flip catch 10 (FIG. 6*b*) into the recess in the profile slat, which in this case is end slat 3. The flip catch is thus disengaged in order to allow the roll-up blind, gate or door to be lifted up. In order to prevent the premature withdrawal of the release bolt 36 from the flip catch 10, the solenoid 35 remains activated until flip catch 10 has securely entered lateral guides 4, in which case it is irrelevant whether or not the unlocking action is initiated by the upward movement of the motor drive.

This circuitry permits a simple electrical delay, thus obviating the requirement for special, separate delay elements. Moreover, unlocking bolts 39 can, like unlocking bolt 25, be embodied as an elastic/resilient shaft which, as described earlier, maintains the head of the unlocking bolt 38, which interacts with flip catch 10, in a depressed position by bending as the flip catch 10 moves upwardly.

Figure 7A:
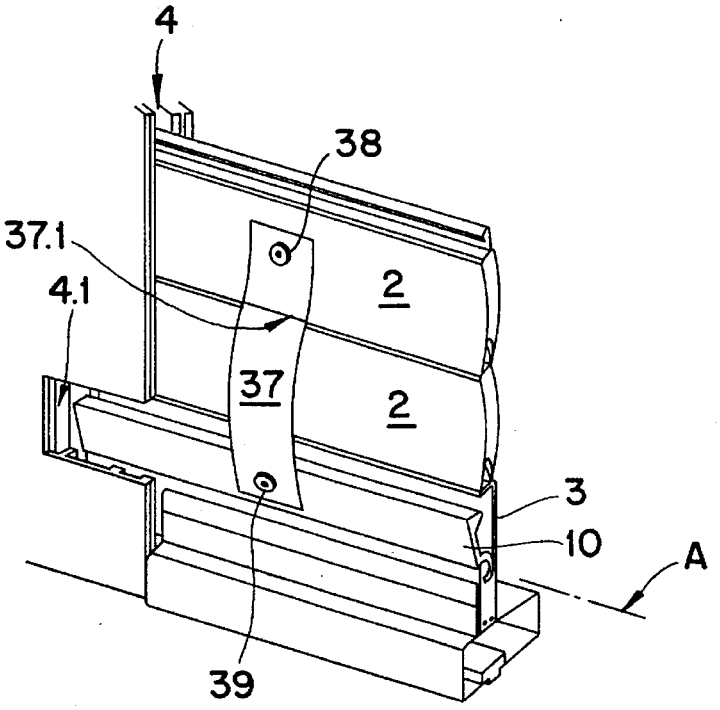
FIG. 7*a* is a perspective view of a spring-biased flip catch in a locked position.
Figure 7B:
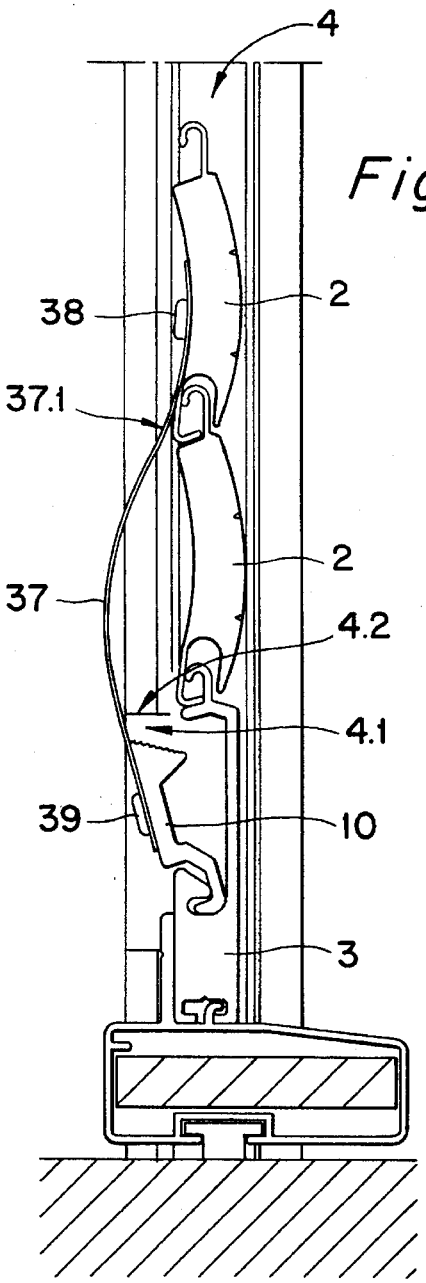
FIG. 7*b* is a side view of FIG. 7*a*.
Figure 7C:
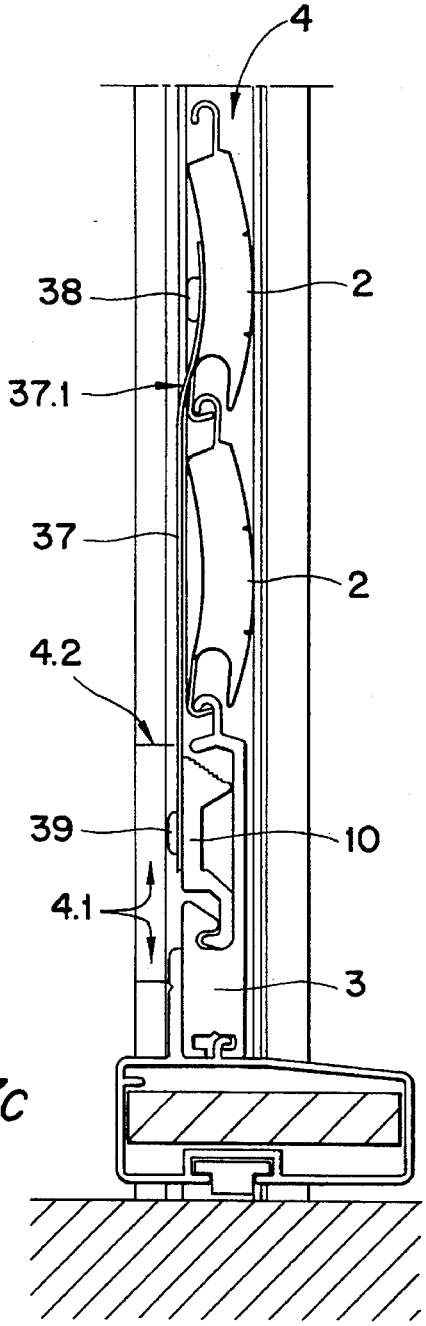
FIG. 7*c* illustrates the blind of FIGS. 6 and 7*b* beginning to be raised, i.e., set to be opened to "gap".

FIGS. 7*a* and 7*b* show an embodiment of the roll-up blind with slats 2 and an end slat 3, which is provided with a flip catch 10 that flips out when the roll-up blind is in the closed position, and when the roll-up blind is raised, occupies the cavity inside end slat 3, which enables the catch to run into the lateral guides 4, without being restrained by stopping edge 4.2, which, constituting the upper side of recess 4.1, can also be specially embodied as a blocking projection (FIGS. 3 and 4). In order to bring flip catch 10 securely out of the unlocked position into the locked position (indicated by 10'), a band spring 37 is provided, which is attached at one end by means of rivets or screws 39 to flip-out the catch 10. The other end of the spring 37 is attached by rivets or screws 38, to one of the slats 2 or the roll-up blind located above the end slat 3. When the roll-up blind is closed (FIGS. 7*a* and 7*b*), flip catch 10 tips out of the cavity of end slat 3, as biased by the tension stored in band spring 37; hindrances to the free motion of flip catch 10, such as, for example, dirt, or unusual temperature conditions, can be overcome by the force of the spring. Band spring 37 possesses, in the region of its connection to slat 2, a bending area 37.1 that permits prestressing. Should an attempt be made to lift up the blind in order to circumvent its function as a security system against break-ins, the flipped-out catch will be pressed against the upper boundary 4.2 of the notch 4.1 that is located in lateral guides 4 or against a blocking projection provided at this location (FIGS. 3 and 4). In this arrangement, the pressing force increases in response to the lifting force exerted against the blind. Should the blind be opened to a certain extent, the slats will, one after the other, from top to bottom, be set to the "gap" position. If each of the slats 2 is set to "gap" relative to the adjacent slat, including end slat 3, the latter is lifted off the base on which it rests, as FIG. 7*c* indicates. When the slats are set to the "gap" position, the slat of slats 2, which is attached to the band spring 37, is lifted up, while the end slat remains unmoved. Thus, band spring 37 is stressed, and flip catch 10 returns to the cavity inside end slat 3, which permits the latter to run unhindered into the lateral guides 4.

Although embodiments of the invention have been described above, it is not limited thereto and it will be apparent to those skilled in the art that numerous modifications form part of the present invention insofar as they do not depart from the spirit, nature and scope of the claimed and described invention.

What is claimed is:

1. Apparatus for closing an opening, comprising:

a frame forming an opening disposed in a vertical plane;

a stationary guide mounted adjacent said frame and defining a pair of horizontally spaced, vertical guide channels, at least one of said guide channels including a recess extending laterally relative to said vertical plane;

a roll-up closure including a plurality of horizontally extending, vertically adjacent slats, each slat including opposite ends slidably movable in respective ones of said guide channels, a lowermost one of said slats including a cavity extending along the complete horizontal length of said lowermost slat from one said end to the other, said cavity disposed in a plane oriented parallel to a plane in which said recess is disposed;

a raising mechanism for raising said closure;

a locking catch pivotably mounted in said cavity for pivotal movement about a horizontal axis and extending substantially parallel to said length of said lowermost slat and having opposite ends vertically slidable in respective ones of said guide channels, said catch being biased to project out of said cavity and into said recess when said closure is in a closed position covering said opening, said catch when projecting into said recess, being positioned to engage a portion of said guide to prevent raising of said closure; and releasing means for retracting said catch out of said recess and into said cavity for enabling said closure to be raised.

2. The apparatus according to claim 1, wherein said catch has a weight distribution causing said catch to be biased out of said cavity.

3. The apparatus according to claim 1, wherein one end of said catch comprises a hook-shaped foot loosely received in a groove of its respective slat to form a pivotal mounting for said catch, an opposite end of said catch including a head, said foot disposed farther within said cavity than said head.

4. The apparatus according to claim 1 wherein each of said guide channels includes a said recess, said recesses being disposed in a common plane.

5. The apparatus according to claim 1 including a spring for biasing said catch out of said cavity.

6. The apparatus according to claim 5, wherein said spring comprises a band spring, one end of said band spring being connected to said catch, and the other end thereof connected to a slat other than said slat to which said catch is mounted.

7. The apparatus according to claim 4, wherein inserts are disposed in said recesses to prevent said catch from being accessed from the outside.

8. The apparatus according to claim 1, wherein said recess includes an inclined upper edge arranged to cam said catch into said cavity when said closure is being raised.

9. The apparatus according to claim 1, wherein said releasing means comprises a member mounted in said frame for pushing said catch into said cavity.

10. The apparatus according to claim 9, wherein said member comprises an elastically bendable rod having a catch-engaging end.

11. The apparatus according to claim 10, wherein said rod includes another end disposed on an internal side of said frame.

12. The apparatus according to claim 11, wherein said rod is horizontally slidable.

13. The apparatus according to claim 12 further including a stationary stop with which said rod is engageable when in a catch-contacting position, for releasably holding said rod in said catch-contacting position.

14. The apparatus according to claim 13, wherein said rod is elastically bendable to be bent upwardly in response to raising of said closure when said rod is in a catch-engaging position for being released from said stop.

15. The apparatus according to claim 9 including an electric servo motor for moving said member.

16. The apparatus according to claim 15, wherein said raising means comprises a lifting motor for raising said closure, said servo motor connected to said lifting motor for keeping said member in a catch-engaging position for a predetermined period following actuation of said lifting motor for raising said closure.

17. The apparatus according to claim 1, wherein said raising means comprises a cable.

18. The apparatus according to claim 17, wherein said cable is connected to said catch for pulling said catch into said cavity before raising said closure.

19. The apparatus according to claim 18, wherein said cable passes through apertures in the ones of said slats located above said slat in which said catch is mounted.

20. The apparatus according to claim 19, wherein said apertures are disposed in portions of said slats located in said guide channels.

21. The apparatus according to claim 1 wherein said catch extends along the complete length of said lowermost slat.

22. A roll-up closure adapted to be mounted in a frame for covering/exposing a vertical opening in said frame, said closure comprising:

a plurality of horizontally extending, vertically adjacent slats, an endmost one of said slats including a cavity extending substantially the length thereof; and a locking catch pivotably mounted in said cavity for rotation about an axis extending substantially parallel to said length, said catch extending substantially the length of said cavity and being biased to rotate about said axis to project outwardly of said cavity and serve as a stop for preventing the closure from being raised.

23. The roll-up closure according to claim 22, wherein said catch has a weight distribution causing said catch to be biased outwardly of said cavity.

24. The roll-up closure according to claim 22 including a spring for biasing said catch out of said cavity.

25. The roll-up closure according to claim 24, wherein said spring comprises a band spring, one end of said band spring connected to said catch, and the other end thereof connected to a slat other than the slat in which said catch is mounted.

26. The roll-up closure according to claim 24, further including a cable connected to said catch for pulling said catch into said cavity and raising said slats.

27. The apparatus according to claim 22 wherein both said cavity and said catch extend along the complete length of said endmost slat.

* * * * *